US008773226B2

(12) United States Patent
Li et al.

(10) Patent No.: US 8,773,226 B2
(45) Date of Patent: Jul. 8, 2014

(54) DRIVING DEVICE AND RELAY

(71) Applicant: Johnson Electric S.A., Murten (CH)

(72) Inventors: Yue Li, Hong Kong (CN); Bao Ting Liu, Shenzhen (CN); Jin Yun Gan, Hong Kong (CN); Chui You Zhou, Hong Kong (CN); Yong Wang, Shenzhen (CN); Xiao Ning Zhu, Shenzhen (CN)

(73) Assignee: Johnson Electric S.A., Murten (CH)

( * ) Notice: Subject to any disclaimer, the term of this patent is extended or adjusted under 35 U.S.C. 154(b) by 0 days.

(21) Appl. No.: 13/780,825

(22) Filed: Feb. 28, 2013

(65) Prior Publication Data

US 2013/0229245 A1 Sep. 5, 2013

(30) Foreign Application Priority Data

Mar. 1, 2012 (CN) ..... 2012 1 0051723

(51) Int. Cl.
*H01H 67/02* (2006.01)

(52) U.S. Cl.
USPC ..... 335/136; 335/128

(58) Field of Classification Search
USPC ..... 335/136
See application file for complete search history.

(56) References Cited

U.S. PATENT DOCUMENTS

| | | | | | |
|---|---|---|---|---|---|
| 811,996 | A | * | 2/1906 | Barclay | 335/122 |
| 1,000,052 | A | * | 8/1911 | Thordarson | 335/119 |
| 1,101,494 | A | * | 6/1914 | Kirchhoff | 335/90 |
| 2,149,699 | A | * | 3/1939 | James et al. | 335/136 |
| 2,446,299 | A | * | 8/1948 | Nelsen | 335/120 |
| 2,542,945 | A | * | 2/1951 | Rojas et al. | 324/110 |
| 2,564,246 | A | * | 8/1951 | Bourne | 335/181 |
| 2,941,130 | A | * | 6/1960 | Krautwald et al. | 335/230 |
| 3,001,049 | A | * | 9/1961 | Didier | 335/136 |
| 3,257,514 | A | * | 6/1966 | Bohnisch et al. | 335/116 |
| 3,321,722 | A | * | 5/1967 | Cohen | 335/128 |
| 3,330,994 | A | * | 7/1967 | Kussy | 361/154 |
| 3,621,419 | A | * | 11/1971 | Adams et al. | 335/230 |
| 3,713,055 | A | * | 1/1973 | Halbeck | 335/136 |
| 4,134,090 | A | * | 1/1979 | Schuessler et al. | 335/229 |
| 4,259,652 | A | * | 3/1981 | Mattson | 335/128 |

(Continued)

FOREIGN PATENT DOCUMENTS

| | | | |
|---|---|---|---|
| CN | 1396615 | A | 2/2003 |
| CN | 101335155 | A | 12/2008 |
| CN | 101527225 | A | 9/2009 |
| WO | WO-2011/131167 | A2 | 10/2011 |

*Primary Examiner* — Shawki S Ismail
*Assistant Examiner* — Lisa Homza
(74) *Attorney, Agent, or Firm* — Muncy, Geissler, Olds & Lowe, P.C.

(57) ABSTRACT

A relay has a driving device that includes a magnet portion, two electromagnets, a yoke portion fixed to the above elements, and a rocking armature. The magnet portion includes a ferrite permanent magnet polarized in a direction perpendicular to the yoke portion and a bearing surface facing way from the yoke portion. Each electromagnet includes an iron core fixed to the yoke portion and a coil wound thereon. The two iron cores are arranged at opposite sides of the magnet portion. The rocking armature includes two arms connected to each other with an included angle formed therebetween and a convex joint of the two arms. The convex joint abuts against the bearing surface and the rocking armature pivots about the convex joint between a first position and a second position in which the rocking armature contacts a respective one of the iron cores.

8 Claims, 3 Drawing Sheets

(56) References Cited

U.S. PATENT DOCUMENTS

| | | | | | |
|---|---|---|---|---|---|
| 4,286,244 | A * | 8/1981 | Schuessler et al. | 335/230 |
| 4,415,229 | A * | 11/1983 | McCullough | 385/22 |
| 4,499,442 | A * | 2/1985 | Kamo et al. | 335/79 |
| 4,695,813 | A * | 9/1987 | Nobutoki et al. | 335/78 |
| 4,703,293 | A * | 10/1987 | Ono et al. | 335/80 |
| 5,304,970 | A * | 4/1994 | Okamoto et al. | 335/78 |
| 5,309,623 | A * | 5/1994 | Okamoto et al. | 29/602.1 |
| 5,515,019 | A * | 5/1996 | Schedele | 335/78 |
| 6,608,539 | B2 * | 8/2003 | Nobutoki et al. | 335/78 |
| 6,768,405 | B2 * | 7/2004 | Nishida et al. | 335/177 |
| 7,477,119 | B2 * | 1/2009 | Wu | 335/83 |
| 8,008,999 | B2 * | 8/2011 | Morimura | 335/78 |
| 2009/0231070 | A1 * | 9/2009 | Saruwatari et al. | 335/179 |
| 2013/0088011 | A1 * | 4/2013 | Rentschler et al. | 290/48 |

* cited by examiner

DRIVING DEVICE AND RELAY

CROSS REFERENCE TO RELATED APPLICATIONS

This non-provisional patent application claims priority under 35 U.S.C. §119(a) from Patent Application No. 201210051723.5 filed in The People's Republic of China on Mar. 1, 2012.

FIELD OF THE INVENTION

The present invention relates to driving devices and in particular, relates to an electromagnetic driving device used in a relay.

BACKGROUND OF THE INVENTION

A driving device for a bistable relay includes a substantially v-shaped rocking plate and two electromagnets arranged on opposite sides of the rocking plate. The rocking plate is made of magnetic material and is rotatably fixed at the center thereof, so that the rocking plate can rotate about its center. When one of the two electromagnets is energized, it generates a magnetic field to attract an end of the rocking plate. When the other electromagnet is energized, the other end of the rocking plate is attracted to this electromagnet, causing the rocking plate to swing. In this way, a movable contact of the relay that is connected to the rocking plate is driven to contact or separate from a static contact, thereby the relay stays in an on or off state. However, in whichever state, one of the electromagnets of the relay has to be fed with power. This makes the relay high electricity-consuming.

There is a desire for a relay with a driving device having a lower power consumption.

SUMMARY OF THE INVENTION

Accordingly, in one aspect thereof, the present invention provides a driving device comprising: a yoke portion; a magnet portion fixed to the yoke portion and comprising a ferrite permanent magnet polarized along a direction substantially perpendicular to the yoke portion and a bearing surface facing way from the yoke portion; two electromagnets each comprising a iron core fixed to the yoke portion and a coil wound thereon, the two iron cores being arranged at two opposite sides of the magnet portion; and a rocking armature comprising two arms connected to each other with an included angle formed there between and a convex joint of the two arms, the convex joint abutting against the bearing surface so that the rocking armature is capable of pivoting about the convex joint between a first position and a second position to contact a respective iron core.

According to a second aspect, the present invention provides a relay comprising: a static contact piece comprising a static contact; a movable contact piece comprising a movable contact; the driving device for moving the movable contact, a housing that houses the static contact, the movable contact, and the driving device; and a push rod connected to the movable contact and arranged to move the movable contact between an 'off' position where the movable contact is separated from the static contact and an 'on' position where the movable contact bears against the static contact, wherein the driving device comprises: a yoke portion; a magnet portion fixed to the yoke portion and comprising a ferrite permanent magnet polarized along a direction substantially perpendicular to the yoke portion and a bearing surface facing way from the yoke portion; two electromagnets each comprising a iron core fixed to the yoke portion and a coil wound thereon, the two iron cores being arranged at two opposite sides of the magnet portion; and a rocking armature comprising two arms connected to each other with an included angle formed there between and a convex joint of the two arms, the convex joint abutting against the bearing surface so that the rocking armature is capable of pivoting about the convex joint between a first position and a second position to contact a respective iron core, the rocking armature being connected to the push rod to drive the push rod.

Preferably, the push rod is slidably moved along a groove in the housing by the rocking armature.

Preferably, the rocking armature further comprises a ridge at the convex joint, and the magnet portion comprises a groove in the bearing surface that receives the ridge of the rocking armature.

Preferably, the ridge comprises a outer surface that contacts the bottom surface of the groove, the outer surface of the ridged and the bottom surface of the groove are arcuate.

Preferably, each iron core comprises a holding surface facing away from the yoke portion; in the first or second position, the corresponding arm contacts the corresponding holding surface and a part of the bearing surface.

Preferably, the magnet portion further comprises a armature plate, the permanent magnet is sandwiched between the yoke portion and the armature plate, the groove is formed in the armature plate.

Preferably, each iron core has a rectangular cross-section, with a long side of thereof arranged close to the permanent magnet while the other long side is remote from the permanent magnet.

Preferably, the two coils of the electromagnets are wound in opposite directions and are connected together in series.

Preferably, the rocking armature further comprises a concave joint of the two arms and a position slot at the concave joint, the housing further comprises a locating part partially received in the position slot.

Preferably, the movable contact piece comprises a fixed plate fixed to the housing, a movable plate having an end to which the movable contact is fixed, and a plurality of elastic arcuate plates connecting the fixed plate to an end of the movable plate remote from the movable contact, the elastic arcuate plates are thinner than both the fixed plate and the movable plate.

In embodiments of the present invention, power is consumed only when the relay is being switched. This makes the relay more energy efficient. Meanwhile, the magnet is made from ferrite magnet, which is cheaper, to reduce the cost of the relay.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
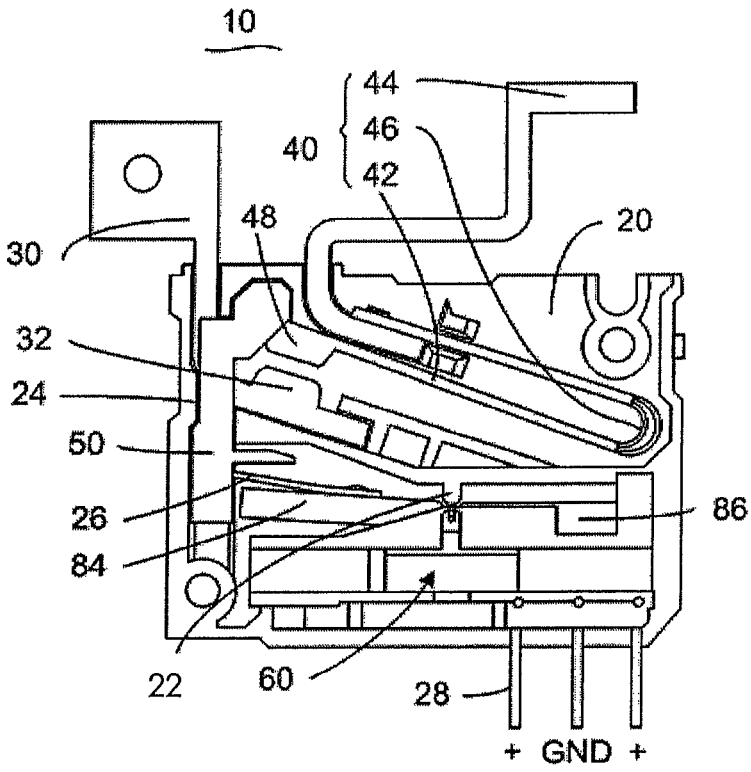
FIG. 1 shows a relay in accordance with a first embodiment of the present invention with part of a housing of the relay removed, the relay is in the off position.

Referring to FIG. 1, a relay 10, according to a first embodiment of the present invention, includes a housing 20, a static contact piece 30, a movable contact piece 40, a push rod 50, and a driving device 60.

The housing 20 is made of plastic. The static contact piece 30 is fixed to the housing 20. An end of the contact piece 30 is provided with a static contact 32 and is received in the housing 20, while the opposite end of the contact piece 30 extends outside the housing for connecting to an external circuit (not shown).

The movable contact piece 40 includes a movable plate 42, a fixed plate 44, and a number of elastic plates 46. An end of the movable plate 42 is provided with a movable contact 48. The fixed plate 44 is fixed to the housing 20. An end of the fixed plate 44 is arranged outside the housing for connecting to the external circuit, while the opposite end is received in the housing 20. The elastic plates 46 are arc-shaped. Two opposite ends of each elastic plate 46 are respectively connected to an end of the movable plate 42 remote from the movable contact 48 and an end of the fixed plate 44 received in the housing 20. Each of the elastic plates 46 is thinner than the other part of the movable contact piece 40 to ease the swing of the movable plate 42 while maintaining the rigidity of the movable plate 42 and the fixed plate 44. The movable contact 48 is arranged opposing the static contact 32.

The push rod 50 is fixed to the driving device 60 and the movable contact 48, and is slidably received in a guiding slot 24 defined in the housing 20. As such, the driving device 60 moves the push rod 50 along the guiding slot 24 to cause the movable contact 48 to contact or separate from the static contact 32.

Figure 2:
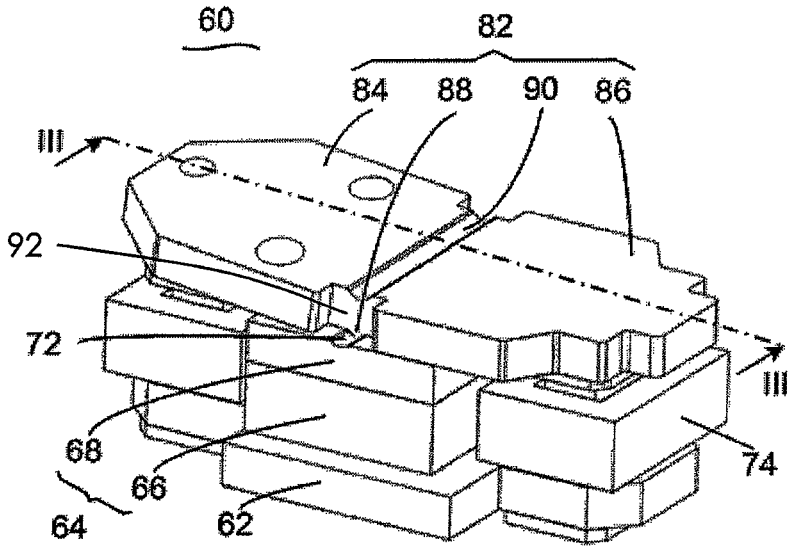
FIG. 2 shows a driving device of the relay of FIG. 1.
Figure 3:
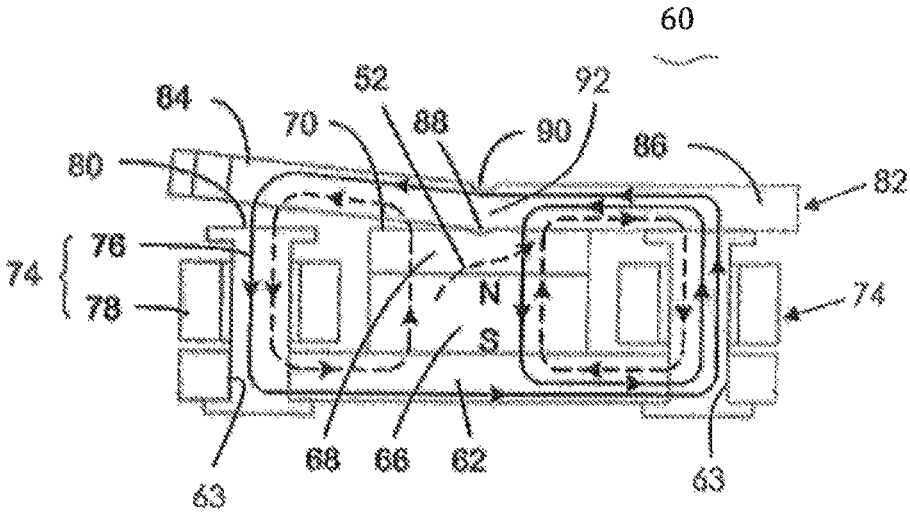
FIG. 3 is a sectional view taken along line III-III of FIG. 2.

Referring to FIGS. 2 and 3, the driving device 60 is received in the housing 20, including a yoke portion 62, a magnet portion 64, two electromagnets 74, and a rocking armature 82. The yoke portion 62 is fixed to the housing 20 and is made from magnetically conductive material, and has two through holes 63 at opposite ends thereof.

The magnet portion 64 includes a permanent magnet 66 and an armature plate 68. The permanent magnet 66 is a ferrite magnet, and is fixed to the middle of the yoke portion 62. The armature plate 68 is made from magnetically conductive material such as iron, and is fixed to an upper surface of the permanent magnet 66. The armature plate 68 includes a bearing surface 70 that faces away from the yoke portion 62 (upper surface as shown). The armature plate 68 further defines a groove 72 that is substantially perpendicular to a line connecting the center of the two through holes 63. The bottom surface of the groove 72 is arc-shaped.

Each electromagnet 74 includes a iron core 76 fixedly received in a respective through hole 63 and a coil 78 wound around the iron core 76. Each iron core 76 includes a holding surface 80 that faces away from the yoke portion 62. The two holding surfaces 80 are both coplanar with the bearing surface 70.

The rocking armature 82 is made from magnetically conductive material, including a first arm 84 and a second arm 86. The first arm 84 and the second arm 86 are both flat-shaped and are connected to each other, with an angle included there between. A ridge 88 is arranged at the convex joint of the first and second arms 84, 86, and is received in the groove 72. The surface of the ridge 88 is shaped to correspond with the bottom surface of the groove 72. The rocking armature 82 is preferably integrally formed as a monolithic structure. The first arm 84 can be connected to the push rod 50 directly or through a connecting rod 26 (as shown in FIG. 1).

During operation, assume that the rocking armature 82 is in a first position, namely, the second arm 86 is touching the iron core 76 remote from the push rod 50 (the right iron core in FIG. 3). In this first position, the second arm 86 contacts the holding surface 80 of the right iron core 76 and the right half of the bearing surface 70 in FIG. 3. As the armature plate 68, the rocking armature 82, the iron core 76, and the yoke portion 62 are all magnetically permeable, the flow of magnetic flux of the permanent magnet 66 is as shown by dashed lines with arrows in FIG. 3. As can be clearly seen, magnetic force caused by the permanent magnet 66 between the second arm 86 and the right iron core 76 is much greater than that between the first arm 84 and the left iron core 76. As such, the rocking armature 82 remains in the first position without applying power to the relay 10. In this case, the push rod 50 is in a high position as shown in FIG. 1, forcing the movable contact 48 to separate from the static contact 32. Thus the relay is in the off state.

Figure 4:
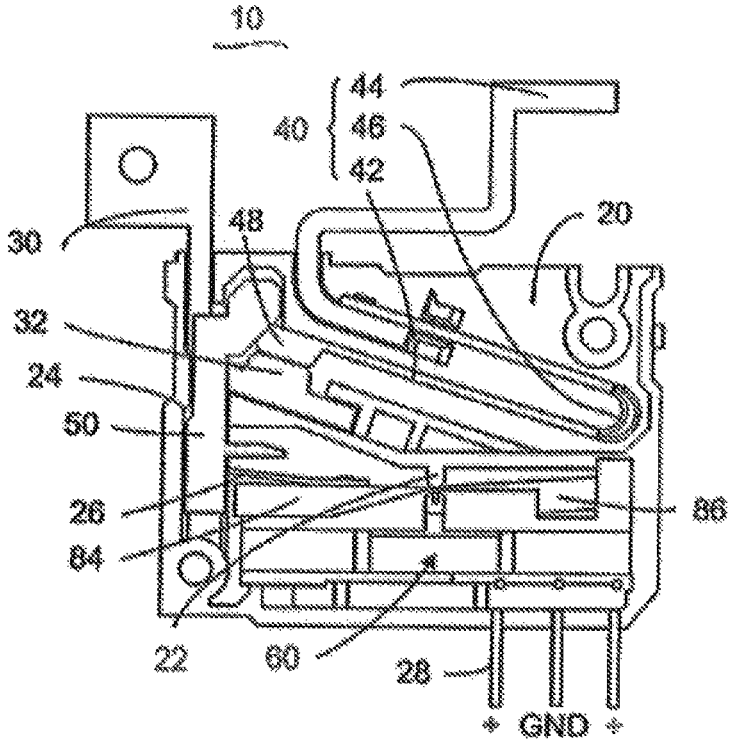
FIG. 4 is a similar view to FIG. 1, with the relay in the on position.

When there is a need to switch the relay 10, a pulse is applied to the right electromagnet 74 through a leg 28 of the relay 10, for example, the positive leg on the right of FIG. 1. The right electromagnet 74 then generates a magnetic field whose flow is shown by the solid line with arrows in FIG. 3. In this case, the magnetic field generated by the right electromagnet 74 weakens or even counteracts the magnetic field generated by the permanent magnet 66 between the right iron core 76 and the second arm 86. While at the same time, the magnetic field generated by the right electromagnet 74 overlaps with the magnetic field generated by the permanent magnet 66 between the left iron core 76 and the first arm 84. As such, the magnetic force between the left iron core 76 and the first arm 84 is greater than that of the right iron core 76 and the second arm 86 and thus the first arm 84 is moved to contact the left iron core 76 so that the rocking armature 82 is switched to a second position, the 'on' position, as shown in FIG. 4.

In the second position, the first arm 84 contacts the holding surface of the left iron core 76 and the left half of the bearing surface 70. The push rod 50 is moved to a low position as shown in FIG. 4, forcing the movable contact 48 to contact the static contact 32. When the relay 10 has to be switched again, a pulse is applied to the left electromagnet 74 via another leg 28. The principle of this pulse is similar to that described above and will not be described again here.

In the present embodiment, the permanent magnet 66 is a ferrite magnet, which is cheaper than rare earth magnets such as NdFeB magnet, to reduce the cost of the relay 10. Preferably, considering that the magnetism of ferrite magnetic is lower than that of rare earth magnets, the iron core 76 is shaped as a rectangle, with the short side shown in FIG. 3. That is, a long side of the iron core 76 is arranged close to the permanent magnet while the other long side is away from it. In this way, comparing to a relay employing square or circular iron cores, more room is left between the two electromagnets 74 for the permanent magnet 66 while the magnetism of the electromagnets remain the same.

It should be understood that the magnetic poles of the permanent magnet 66 can be reversed. In the above embodiment, the two electromagnets 74 are electrically separate from each other so that only one of them is energized when switching the relay 10. However, in other embodiments, the coils 78 of the two electromagnets 74 can be wound in opposite directions and connected together in series, as shown schematically in FIG. 5. In this way, when switching the relay, both electromagnets 74 can be applied with the same pulses to generate opposite magnetic fields to enhance the switching magnetic force.

Preferably, the housing 20 further includes a locating part 22, as shown in FIG. 1. The rocking armature 82 further defines a position slot 90 at the concave joint 94 of the first and second arms 84, 86, opposite to the ridge 88. A distal end of the locating part 22 is received in the position slot 90 to locate the rocking armature 82.

The arrangement of the groove 72 and the ridge 88 not only facilitates the pivoting of the rocking armature 82, but also lowers the magnetic reluctance between the rocking armature 82 and the iron cores 76 and the armature plates 68 as it ensures contact between the rocking armature 82 and the bearing surface 70 and the holding surfaces 80 in the first and second positions, with virtually no air gap.

Figure 5:
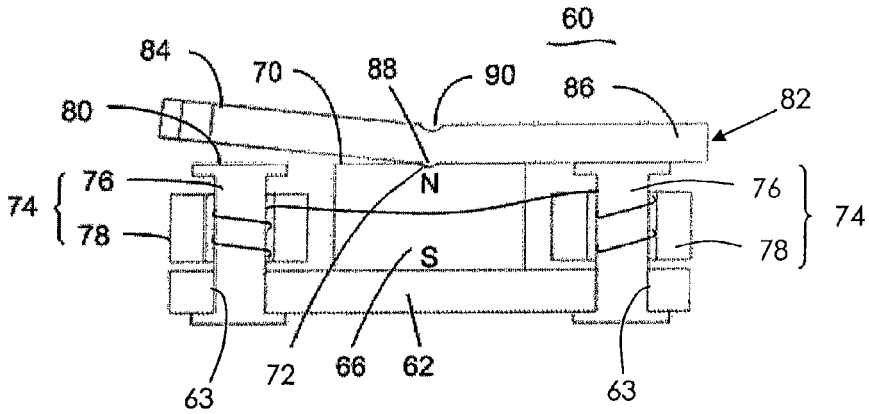
FIG. 5 is a sectional view of a driving device according to a second embodiment of the present invention.

The armature plate 68 allows most of the magnetic field of the N pole of the permanent magnet 66 to go to the arm of the rocking armature 82 that is in contact with a corresponding iron core 76, which is schematically demonstrated by dashed line 52 in FIG. 3. Compared to relays without an armature plate 68, the magnetic force between the arm and iron core when in contact is relatively high. However, it should be understood that without the armature plate 68, the relay can still work properly. In this situation, the groove 72 is defined in the permanent magnet 66, as shown in FIG. 5.

Figure 6:
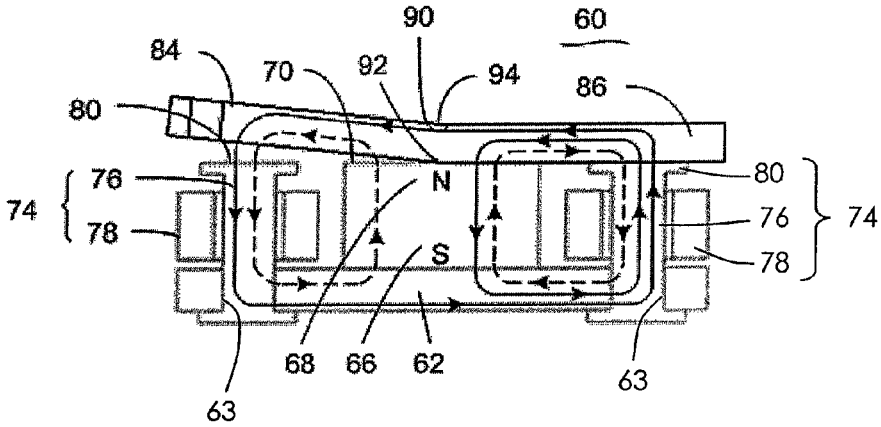
FIG. 6 is a sectional view of a driving device according to a third embodiment of the present invention.

In other embodiments, the ridge 88 may be eliminated from the convex joint 92 of the two arms 84, 86, as shown in FIG. 6. In this case, still no air gap exists between contacting arm and iron core, just like the first embodiment. The position slot 90 is preferably formed at the concave joint 94 of the two arms 84, 86 to receive the locating part 22.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A relay, comprising:

a static contact piece comprising a static contact;

a movable contact piece comprising a movable contact;

a driving device comprising;

a yoke portion;

a magnet portion fixed to the yoke portion and comprising a ferrite permanent magnet polarized along a direction substantially perpendicular to the yoke portion and a bearing surface facing way from the yoke portion;

two electromagnets each comprising a iron core fixed to the yoke portion and a coil wound thereon, the two iron cores being arranged at two opposite sides of the magnet portion; and a rocking armature comprising two arms connected to each other with an included angle formed therebetween and a convex joint of the two arms, the convex joint abutting against the bearing surface so that the rocking armature is capable of pivoting about the convex joint between a first position and a second position to contact a respective iron core;

a housing that houses the static contact, the movable contact, and the driving device; and a push rod connected to the movable contact and the arm of the rocking armature, and being arranged slidably along a direction in the housing so that the movable contact is moved to separate from or to contact the static contact by the push rod in the first or second position of the rocking armature;

the movable contact piece comprises a fixed plate fixed to the housing, a movable plate having an end to which the movable contact is fixed and a plurality of elastic arcuate plates connecting the fixed plate to an end of the movable plate remote from the movable contact, the elastic arcuate plates are thinner than both the fixed plate and the movable plate.

2. The driving device of claim 1, wherein the rocking armature further comprises a ridge at the joint, and the magnet portion comprises a groove in the bearing surface that receives the ridge of the rocking armature.

3. The driving device of claim 2, wherein the ridge comprises a outer surface that contacts the bottom surface of the groove, the outer surface of the ridge and the bottom surface of the groove are arcuate.

4. The driving device of claim 2, wherein each iron core comprises a holding surface facing away from the yoke portion, and wherein in the first or second position, the corresponding arm contacts the corresponding holding surface and a part of the bearing surface.

5. The driving device of claim 4, wherein the magnet portion further comprises an armature plate, the permanent magnet is sandwiched between the yoke portion and the armature plate, the groove is arranged in the armature plate.

6. The driving device of claim 1, wherein each iron core has a rectangular cross section, with a long side of thereof arranged close to the permanent magnet while the other long side is remote from the permanent magnet.

7. The driving device of claim 1, wherein the two coils of the electromagnets are wound in opposite directions and are connected together in series.

8. The driving device of claim 1, wherein the rocking armature further comprises a concave joint of the two arms and a position slot at the concave joint, the housing further comprises a locating part partially received in the position slot.

* * * * *